US007484500B2

(12) United States Patent
Terada

(10) Patent No.: US 7,484,500 B2
(45) Date of Patent: Feb. 3, 2009

(54) FUEL VAPOR TREATMENT APPARATUS

(75) Inventor: Yoshinobu Terada, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 26 days.

(21) Appl. No.: 11/731,533

(22) Filed: Mar. 30, 2007

(65) Prior Publication Data

US 2007/0227514 A1 Oct. 4, 2007

(30) Foreign Application Priority Data

Mar. 30, 2006 (JP) ..... 2006-095942

(51) Int. Cl.
*F02M 37/20* (2006.01)
*F02M 33/02* (2006.01)

(52) U.S. Cl. ..... 123/516; 123/519; 123/520

(58) Field of Classification Search ..... 123/516, 123/518, 519, 520
See application file for complete search history.

(56) References Cited

U.S. PATENT DOCUMENTS 5,275,145 A * 1/1994 Tuckey ..... 123/521
5,482,024 A * 1/1996 Elliott ..... 123/516
5,495,749 A * 3/1996 Dawson et al. ..... 73/49.7
5,970,957 A * 10/1999 Fried et al. ..... 123/516
6,112,728 A * 9/2000 Schwegler et al. ..... 123/520
6,234,153 B1 * 5/2001 DeGroot et al. ..... 123/525
6,389,882 B1 * 5/2002 Ohkuma ..... 73/49.7
6,698,402 B2 * 3/2004 Biesinger et al. ..... 123/520
6,769,418 B1 * 8/2004 Reddy ..... 123/520
6,889,667 B2 * 5/2005 Fritz et al. ..... 123/520
7,261,092 B1 * 8/2007 Oku et al. ..... 123/516
2002/0046740 A1 * 4/2002 Biesinger et al. ..... 123/520
2002/0185115 A1 * 12/2002 Capshaw et al. ..... 123/518
2003/0205272 A1 * 11/2003 Benjey et al. ..... 137/202

FOREIGN PATENT DOCUMENTS

JP 2002-130061 5/2002
JP 2003-049686 2/2003

* cited by examiner

*Primary Examiner*—Thomas N Moulis
(74) *Attorney, Agent, or Firm*—Carrier, Blackman & Associates, P.C.; William D. Blackman; Joseph P. Carrier

(57) ABSTRACT

A fuel vapor treatment apparatus includes a canister, a fuel vapor supply tube and a booster pump. The booster pump compresses fuel vapors retained in the canister and feeds the fuel vapors in the form of a compressed gas to fuel injectors of an engine via the fuel vapor supply tube.

19 Claims, 7 Drawing Sheets

FUEL VAPOR TREATMENT APPARATUS

FIELD OF THE INVENTION

The present invention relates to a fuel vapor treatment apparatus having a canister for temporarily storing fuel vapors generated in a fuel tank.

BACKGROUND OF THE INVENTION

A fuel vapor treatment apparatus stores the fuel vapors generated in a fuel tank in a canister and supplies the fuel vapors stored in the canister to an engine when the engine is started. Such a fuel vapor treatment apparatus is described in JP-A-2003-49686.

A summary of a fuel supply apparatus provided with a fuel vapor treatment apparatus described in JP-A-2003-49686 is described with reference to FIG. 7 hereof. FIG. 7 is an explanatory view of the outline of a fuel supply apparatus provided with a conventional fuel vapor treatment apparatus.

A fuel supply apparatus 200 is composed of a fuel tank 201 for holding liquid fuel, a filler pipe 202 for supplying liquid fuel to the fuel tank 201, a fuel pump 203 for discharging liquid fuel inside the fuel tank 201, and a fuel supply tube 206 for supplying liquid fuel discharged from the fuel pump 203 to an injector 205 of an engine 204.

The fuel supply apparatus 200 is furthermore provided with a fuel vapor treatment apparatus 210. The fuel vapor treatment apparatus 210 is composed of a canister 211 for storing fuel vapors by adsorption, a fuel vapor introduction tube 212 for introducing the fuel vapors in the fuel tank 201 into the canister 211, and a fuel vapor supply tube 213 for supplying the fuel vapors inside the canister 211 to an intake system 207 of the engine 204.

In the fuel vapor treatment apparatus 210, the fuel vapors inside the fuel tank 201 is temporarily stored in the canister 211 and is fed from the canister 211 to the intake system 207 by using negative suction pressure generated in the intake system 207 when the engine 204 is started.

The amount of fuel vapors stored in the canister 211 differs depending on the effect of the outside air temperature and the storage state of the fuel vapors produced by the canister 211. For this reason, the feed rate (concentration) of the fuel vapors fed from the canister 211 to the intake system 207 of the engine varies. However, the engine 204 is controlled without consideration for the concentration of the fuel vapors fed to the intake system 207. The combustion state of the engine 204 can vary with the concentration of the supplied fuel vapors. Improvements can be made to more suitably control the engine 204.

The negative suction pressure of the intake system 207 can also fluctuate in accordance with the operating state of the engine 204. When the negative pressure is low, the feed rate of the fuel vapors from the canister 211 to the intake system 207 is reduced. In other words, the rate at which the fuel vapors can be purged (scavenged, released) from the canister 211 to the engine 204 is reduced.

In view of the above, there is a need for method that can more suitably and easily control the engine, and that can more suitably feed fuel vapors from the canister to the engine.

SUMMARY OF THE INVENTION

According to the present invention, there is provided a fuel vapor treatment apparatus which comprises: a canister for temporarily retaining fuel vapors generated in a fuel tank; a first fuel vapor supply tube for allowing passage of the fuel vapors from the fuel tank to the canister; a second fuel vapor supply tube for allowing passage of the fuel vapors from the canister to fuel injectors of an engine; and a booster pump disposed on the second fuel vapor supply tube and adapted to suction outside air via the canister to purge the fuel vapors from the retention by the canister, to compress the purged fuel vapors and the suctioned outside air, and to feed the purged fuel vapors and the suctioned outside air in the form of a compressed gas to the fuel injectors via the second fuel vapor supply tube.

With this arrangement, fuel vapors can be forcibly fed in the form of a compressed gas to the fuel injectors via the fuel vapor supply tubes by using a booster pump to suction and compress the fuel vapors temporarily stored in the canister.

In addition to liquid fuel fed from the fuel tank, fuel vapors in the form of a compressed gas are fed to the fuel injectors. In other words, liquid fuel and fuel vapors can both be brought together and fed to the fuel injectors. The injection rate of the fuel injectors is controlled in accordance with the operating conditions of the engine. For this reason, the engine can be more suitable and easily controlled regardless of the feed rate of the fuel vapors. Also, the exhaust gas of the engine can be made cleaner (less polluting).

The fuel vapors are compressed by the booster pump and fed in the form of a compressed gas to the fuel injectors. Therefore, the feed rate of the fuel vapors does not vary due to the effect of the negative suction pressure in the intake system of the engine. Accordingly, fuel vapors can be more suitably fed from the canister to the engine.

Since the fuel vapor treatment apparatus is merely provided with a fuel vapor supply tube and a booster pump, fuel can be brought together and fed to the engine by using a simple configuration.

Preferably, the second fuel vapor supply tube is connected to a midway point of a fuel supply tube for supplying liquid fuel from the fuel tank to the fuel injectors, so that the purged fuel vapors are fed to the fuel injectors.

Desirably, the fuel vapor treatment apparatus further comprises a controller for controlling a rate of discharge of the compressed gas from the booster pump in accordance with operating conditions when the engine is operating.

In a preferred form, the operating conditions include a level of opening of a throttle valve.

In a still preferred form, the operating conditions also include the speed of the engine.

Preferably, the treatment apparatus further comprises: an amount detector for detecting an amount of the fuel vapors retained by the canister; and a controller for actuating the booster pump only when the amount of retention is greater than a predetermined reference retention amount.

Desirably, the treatment apparatus further comprises: a refuel detector for detecting that the fuel tank is being refueled; and a controller for actuating the booster pump in accordance with a detection signal from the refuel detector.

Preferably, the refuel detector comprises a lid open/close sensor for detecting that the refueling lid, which is opened when fuel is to be fed from the exterior to the fuel tank, has been opened.

The refuel detector may comprise a fuel gauge for detecting a reservoir level of the fuel held in the fuel tank.

The treatment apparatus may further comprise: an auxiliary fuel vapor supply tube branched from the second fuel vapor supply tube and connected to an intake system of the engine; and a purge valve disposed on the auxiliary fuel vapor supply tube and adapted to open when the booster pump is stopped.

BRIEF DESCRIPTION OF THE DRAWINGS

Certain preferred embodiments of the present invention will be described in detail below, by way of example only, with reference to the accompanying drawings, in which.

DESCRIPTION OF THE PREFERRED EMBODIMENTS

Figure 1:
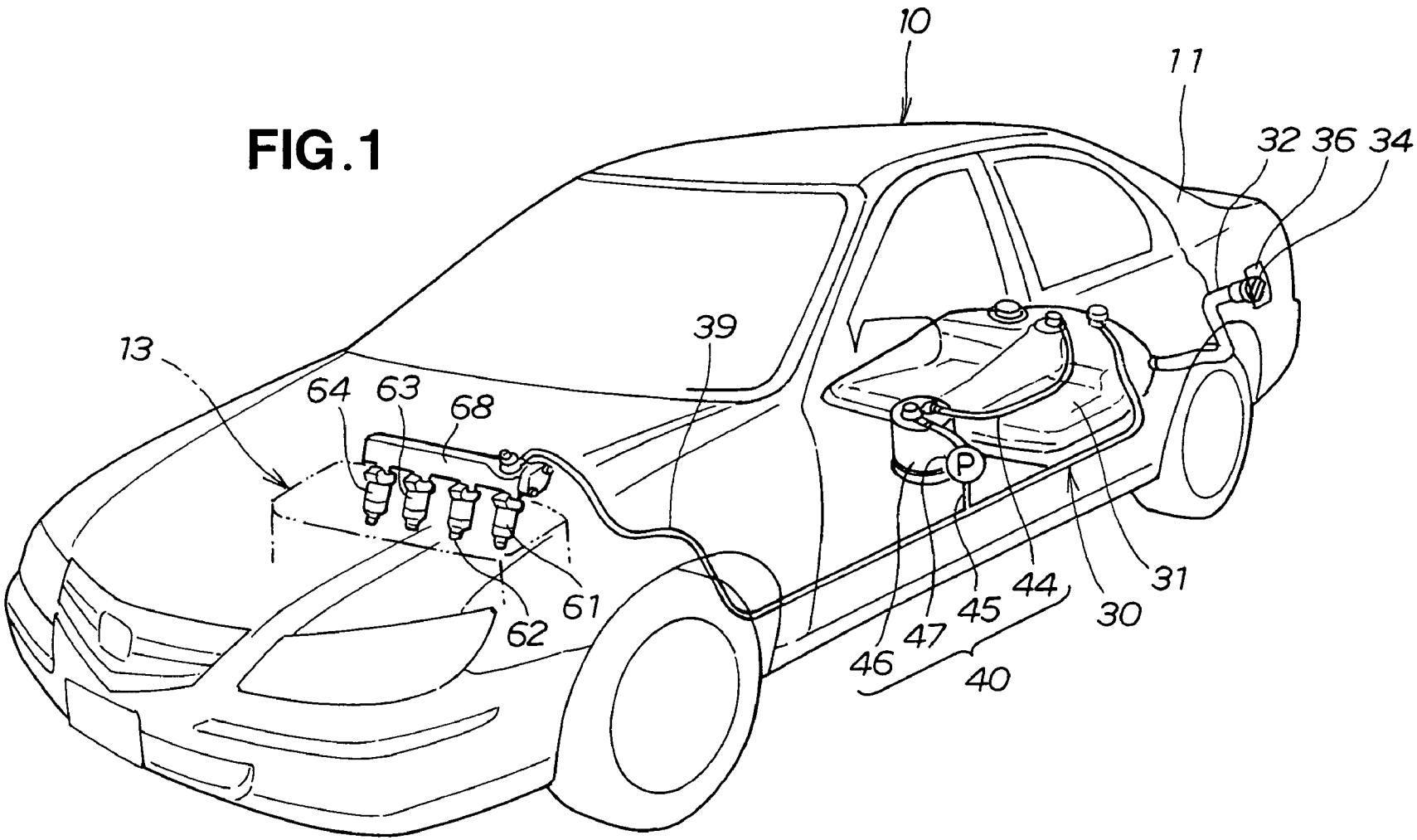
FIG. 1 is a schematic perspective view illustrating a vehicle employing a fuel supply apparatus with a fuel vapor treatment apparatus according to the present invention.
Figure 2:
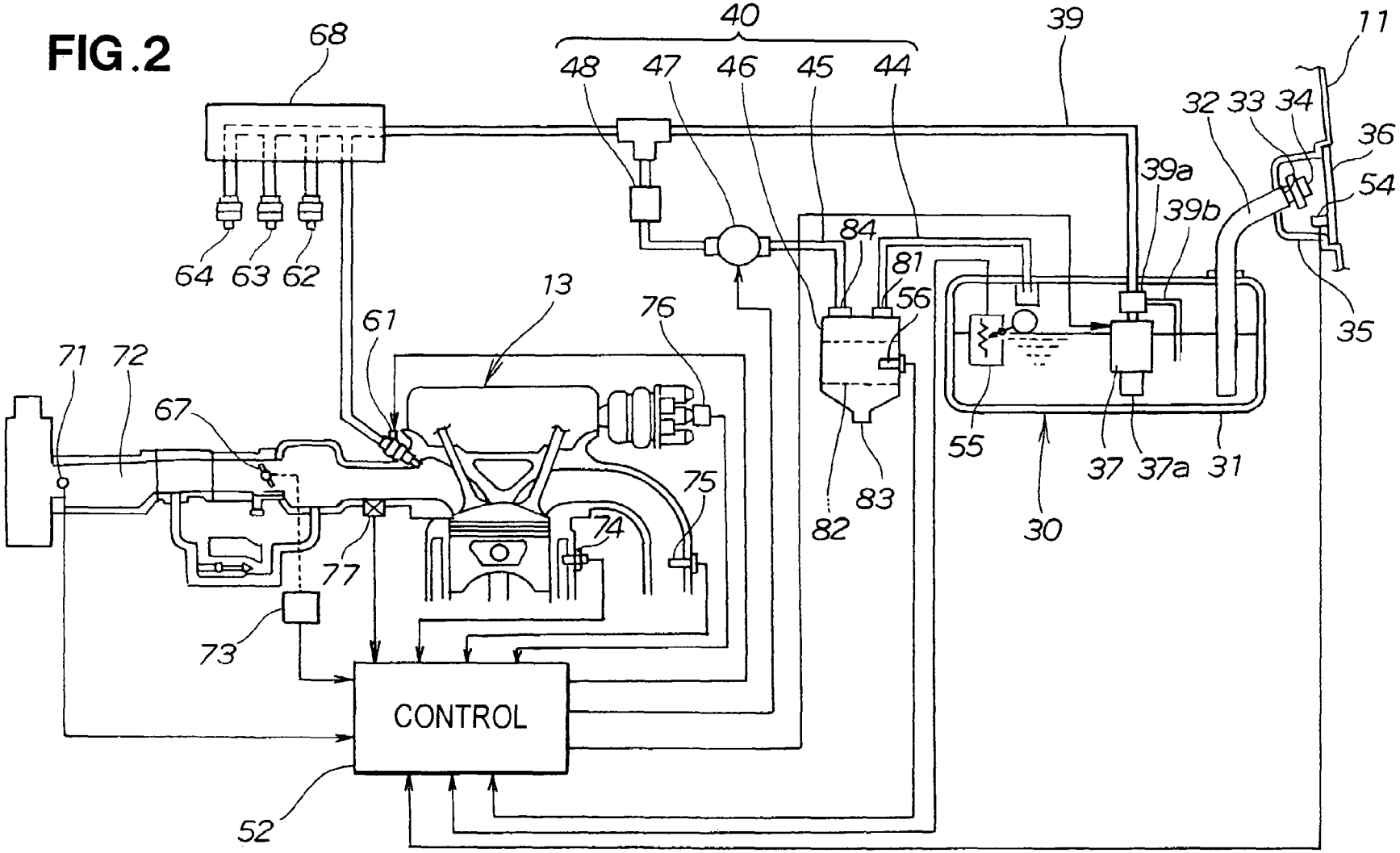
FIG. 2 is a diagrammatical view illustrating the fuel supply apparatus and an engine shown in FIG. 1.

Initial reference is made to FIG. 1 showing a vehicle 10 employing a fuel supply apparatus 30 provided with a fuel vapor treatment apparatus 40, and to FIG. 2 schematically showing an engine 13 and the fuel supply apparatus 30 of FIG. 1.

As shown in FIGS. 1 and 2, the fuel supply apparatus 30 is composed of a fuel tank 31 for holding fuel, a filler pipe 32 (external supply tube 32) that supplies fuel to the fuel tank 31 from the exterior, a fuel pump 37 that discharges fuel from inside the fuel tank 31, a fuel supply tube 39 that supplies the fuel discharged from the fuel pump 37 to a delivery pipe 68 of the engine 13 (internal combustion engine 13), and a controller 52. The fuel is gasoline or another liquid fuel.

The fuel tank 31 is provided with a fuel gauge 55. The fuel gauge 55 detects the amount of fuel held in the fuel tank 31.

A fuel inlet 33 (refueling port 33) of the filler pipe 32 is covered by a cap 34 and is disposed in a refueling box 35. The refueling box 35 is disposed on the side of the vehicle and is covered by a refueling lid 36. The refueling box 35 is furthermore provided with a lid open/close sensor 54 for sensing that the refueling lid 36 has been opened. When the refueling lid 36 has been opened and the cap 34 removed, fuel can be fed from the fuel inlet 33 to the fuel tank 31.

The fuel pump 37 is disposed inside the fuel tank 31, and is provided with a filter 37*a*. The fuel supply tube 39 has a regulator 39*a* disposed at a midway point. The regulator 39*a* adjusts the fuel pressure and keeps the pressure substantially constant. Surplus fuel is returned from the regulator 39*a* to the fuel tank 31 via a return pipe 39*b*.

The delivery pipe 68 distributes fuel fed from the fuel tank 31 to a plurality of fuel injectors 61, 62, 63, and 64 disposed in the engine 13.

The controller 52 receives detection signals from the lid open/close sensor 54, the fuel gauge 55, an air intake temperature sensor 71, a throttle valve position sensor 73, a water temperature sensor 74, an $O_2$ sensor 75, an engine speed sensor 76, and an air intake pressure sensor 77, and is configured so as to control the engine 13 (including the fuel injectors 61, 62, 63, and 64) and the fuel pump 37.

The air intake temperature sensor 71 detects the temperature of the air suctioned into the intake system 72 of the engine 13. The throttle valve position sensor 73 detects the position of a throttle valve 67. The water temperature sensor 74 detects the temperature of cooling water for cooling the engine 13. The $O_2$ sensor 75 detects the residual oxygen concentration in the exhaust gas exhausted from the engine 13. The engine speed sensor 76 detects the speed of the engine 13. The air intake pressure sensor 77 detects the negative suction pressure downstream from the throttle valve 67 in the intake system 72 of the engine 13.

The fuel supply apparatus 30 is furthermore provided with a fuel vapor treatment apparatus 40. The fuel vapor treatment apparatus 40 is composed of a first fuel vapor supply tube 44, a second fuel vapor supply tube 45, a canister 46, a booster pump 47, a fuel vapor supply tube side regulator 48, and the controller 52 of the fuel supply apparatus 30.

Figure 3:
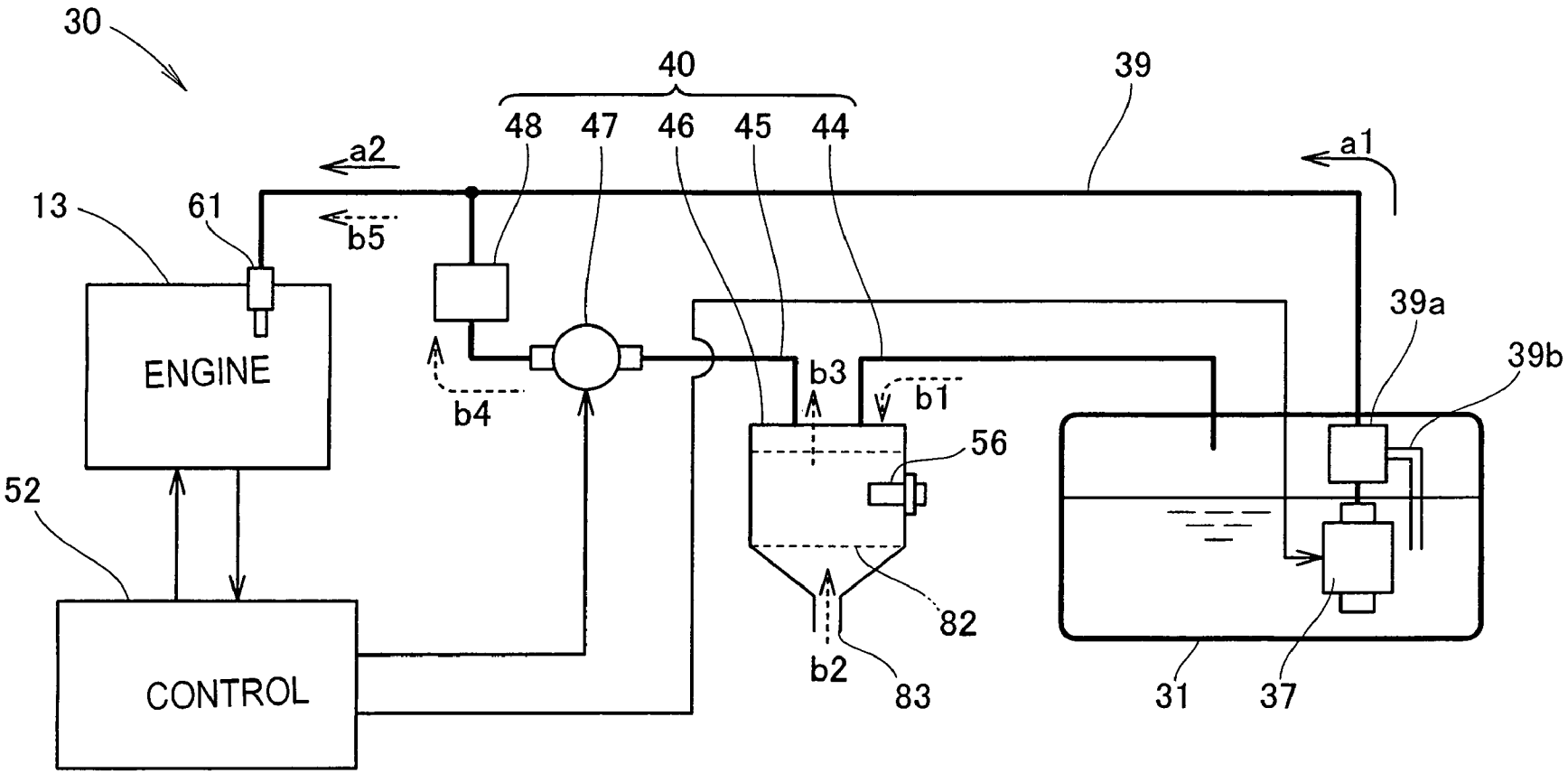
FIG. 3 is a diagrammatical view illustrating the primary arrangement of the fuel supply apparatus and engine shown in FIG. 2.

FIG. 3 further schematically shows the primary configuration of the engine 13 and fuel supply apparatus 30 shown in FIG. 2.

The canister 46 is internally filled with an adsorbent 82, and has a fuel vapor inlet 81, an air hole 83 (breather 83), and a fuel vapor outlet 84, as shown in FIGS. 2 and 3. The adsorbent 82 adsorbs fuel vapors and is composed of, e.g., activated carbon.

The fuel tank 31 is connected to the fuel vapor inlet 81 via the first fuel vapor supply tube 44. The fuel vapor outlet 84 is connected at a midway point of the fuel supply tube 39 via the second fuel vapor supply tube 45. The booster pump 47 and fuel vapor supply tube side regulator 48 are interposed at a midway point of the second fuel vapor supply tube 45.

The fuel vapor supply tubes (first and second fuel vapor supply tubes 44 and 45) are connected at a midway point of the fuel supply tube 39, and the degree of freedom in arrangement and tubing design can therefore be increased in order to dispose the canister 46 in the narrow space of the vehicle 10 (see FIG. 1). The tube arrangement of the first and second fuel vapor supply tubes 44 and 45 can be simplified and tube arrangement space can be reduced. The canister 46 can, for example, be separated from the engine 13 and disposed in proximity to the fuel tank 31.

The fuel vapors generated in the fuel tank 31 is mixed with air inside the fuel tank 31 to form an air/fuel vapor mixture. The air/fuel vapor mixture inside the fuel tank 31 is introduced to the canister 46 via the first fuel vapor supply tube 44. The air/fuel vapor mixture thus introduced is separated when the fuel vapors are adsorbed by the adsorbent 82, and the remaining air is exhausted from the air hole 83 to the atmosphere. Outside air is thereafter introduced from the air hole 83, whereby the fuel vapors that have been adsorbed by the adsorbent 82 are purged (scavenged, released) from the fuel vapor outlet 84 to the fuel supply tube 39 via the second fuel vapor supply tube 45.

When the fuel vapors are adsorbed by the adsorbent 82, the adsorbent 82 generates heat in accordance with the state of the adsorption, and the temperature of the adsorbent 82 increases. When the fuel vapors are thereafter released from the adsorbent 82, the temperature of the adsorbent 82 is reduced in accordance with the state of the release. Therefore, the state of fuel vapor adsorption can be ascertained by measuring the temperature variation of the adsorbent 82.

The canister 46 is provided with a canister temperature sensor 56 for detecting temperature variations of the adsorbent 82 (temperature variations of the canister 46). The canister temperature sensor 56 can indirectly detect the amount of fuel vapors that have been adsorbed in the canister 46 by detecting temperature variations of the adsorbent 82. The canister temperature sensor 56 may be referred to hereinafter as the "adsorption amount detector 56."

The booster pump 47 (fuel vapor supply pump 47) increases the pressure of the fuel vapors that flow through the second fuel vapor supply tube 45 so as to be substantially the same pressure as that inside the fuel supply tube 39. Specifically, the booster pump 47 is configured to suction outside air from the air hole 83 via the canister 46, thereby suctioning the outside air and the fuel vapors adsorbed in the canister 46 and purged by the outside air. The booster pump 47 is furthermore configured so that the outside air and fuel vapors thus suctioned are pressurized and discharged, and are thereby fed in the form of a compressed gas to the fuel injectors 61, 62, 63, and 64 via the second fuel vapor supply tube 45.

The regulator 48 is disposed on the discharge side of the booster pump 47 and is adjusted so that the pressure inside the second fuel vapor supply tube 45 remains substantially constant.

The flow of the liquid fuel and the fuel vapors is described next with reference to FIG. 3.

The fuel pump 37 is actuated to feed liquid fuel held in the fuel tank 31 through the fuel supply tube 39, as indicated by the arrows a1 and a2, to the fuel injectors 61, 62, 63, and 64 (see FIG. 2). The fuel vapors generated inside the fuel tank 31 are mixed with air inside the fuel tank 31 to form an air/fuel vapor mixture.

The air/fuel vapor mixture inside the fuel tank 31 passes through the first fuel vapor supply tube 44, as indicated by the arrow b1, and flows to the canister 46 when the booster pump 47 is stopped. The air/fuel vapor mixture is separated when the fuel vapors are adsorbed by the adsorbent 82, and the remaining air is exhausted from the air hole 83 to the atmosphere.

The booster pump 47 is thereafter actuated to suction outside air into the canister 46, as indicated by the arrow b2, and to purge the fuel vapors that have been adsorbed by the adsorbent 82. As a result, the outside air and the fuel vapors in the canister 46 pass through the second fuel vapor supply tube 45, as indicated by the arrow b3, and are suctioned by the booster pump 47. The outside air and fuel vapors thus suctioned are compressed to substantially the same pressure as that of the fuel supply tube 39, and are pumped in the form of a compressed gas to the fuel supply tube 39, as indicated by the arrow b4 to be merged with the liquid fuel. The fuel vapors thus pumped merge with the liquid fuel flowing inside the fuel supply tube 39, and the fuel vapors and liquid fuel are fed to the fuel injectors 61, 62, 63, and 64 (see FIG. 2), as indicated by the arrow b5, to be injected and combusted in the combustion chamber of the engine 13.

The configuration of the controller 52 is described next in detail with reference to FIG. 4.

Figure 4:
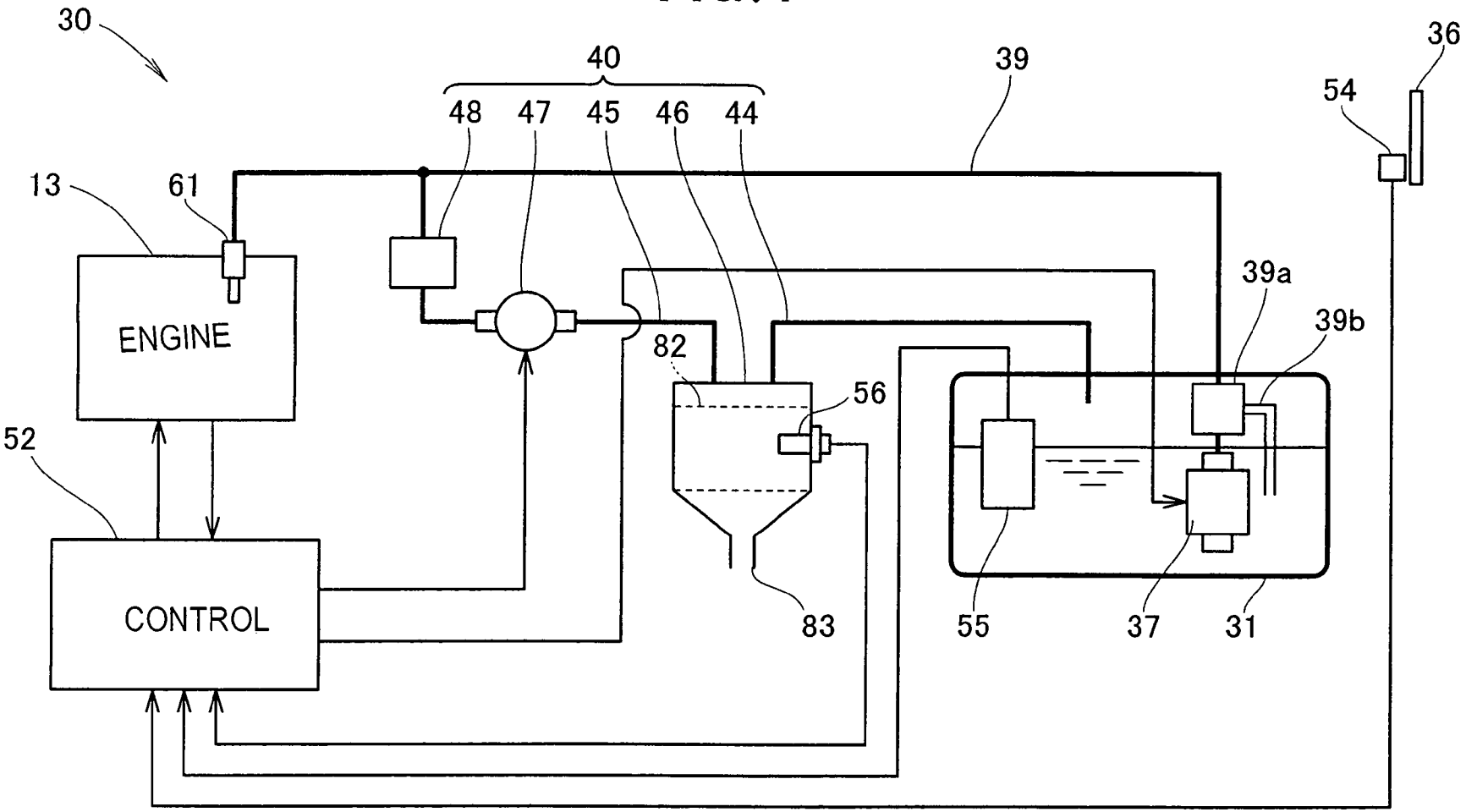
FIG. 4 is a diagrammatical view illustrating the fuel vapor treatment apparatus shown in FIG. 3.

The controller 52 of the fuel supply apparatus 30 also serves as a controller for controlling the booster pump 47, as shown in FIG. 4. In other words, the controller 52 uses the control signals of the engine 13 to control the fuel pump 37 and booster pump 47. Specifically, the controller 52 controls the electric motor that drives the fuel pump 37 and the electric motor that drives the booster pump 47.

More specifically, the controller 52 controls the discharge rate of the booster pump 47 in accordance with operating conditions when the engine 13 is operating. In other words, the controller 52 makes decisions on the basis of the operating conditions when the engine 13 is operating. The discharge rate of the booster pump 47 is controlled in accordance with the fuel injection rate of the fuel injectors 61, 62, 63, and 64 (see FIG. 2)

As used herein, the operating condition of the engine 13 is at least one condition selected from, e.g., a first operating condition and a second operating condition. The first operating condition is the position of the throttle valve 67 detected by the throttle valve position sensor 73 shown in FIG. 2. The second operating condition is the speed of the engine 13 detected by the engine speed sensor 76 shown in FIG. 2.

The controller 52 controls the discharge rate of the booster pump 47 in accordance with at least one of the conditions selected from the first operating condition and the second operating condition. Accordingly, an amount of fuel vapors suitable for the operating condition of the engine 13 can be fed to the engine 13. When the engine 13 is in satisfactory combustion state, the feed rate of the fuel vapors fed from the booster pump 47 to the engine 13 can be increased. As a result, the exhaust gas of the engine 13 can be made cleaner.

The controller 52 furthermore determines that the amount of fuel vapors adsorbed by the adsorbent 82 has increased in a case in which the actual rate of increase is greater than a prescribed reference rate of increase when the temperature of the adsorbent 82 detected by the canister temperature sensor 56 has increased. In other words, the controller 52 determines that the adsorption amount is greater than a prescribed adsorption amount, and actuates the booster pump 47. The controller 52 determines that purging has been completed when the actual rate of decrease has fallen below a prescribed reference decrease rate in a case in which the temperature of the adsorbent 82 detected by the canister temperature sensor 56 has decreased. In other words, the controller 52 determines that the adsorption amount is less than a prescribed adsorption amount, and stops the booster pump 47.

In this manner, the controller 52 actuates the booster pump 47 only when the controller has determined that the adsorption amount is greater than a prescribed reference adsorption amount. The fuel vapors adsorbed by the adsorbent 82 can be actively treated in the engine only when the amount of fuel vapors adsorbed by the adsorbent 82 is considerable. Since fuel vapors having a relatively high concentration can be fed to the engine 13, the combustion state produced by the engine 13 can be further stabilized.

When the fuel tank 31 is being refueled, the refueling lid 36 will necessarily be opened. The lid open/close sensor 54 detects that the refueling lid 36 has been opened. Accordingly, the lid open/close sensor 54 can naturally detect that the fuel tank 31 is being refueled. The lid open/close sensor 54 may be referred to hereinafter as the "refuel detector 54."

The fuel reservoir level increases when the fuel tank 31 is being refueled. The fuel gauge 55 detects the fuel reservoir level in the fuel tank 31. The detection signal of the fuel gauge 55 determines the extent to which the fuel reservoir level is increasing. For this reason, the fuel gauge 55 can naturally detect that the fuel tank 31 is being refueled. The fuel gauge 55 may be referred to hereinafter as the "refuel detector 55."

The controller 52 actuates the booster pump 47 in accordance with at least one signal selected from the detection signal of the lid open/close sensor 54 (refuel detector 54) and the fuel gauge 55 (refuel detector 55). For example, the controller 52 determines that refueling is occurring and actuates the booster pump 47 for a prescribed length of time when the detection signal of the lid open/close sensor 54 has been received. The controller 52 actuates the booster pump 47 for a prescribed length of time when the rate of increase of the fuel reservoir level detected by the fuel gauge 55 has been determined to be greater than a prescribed reference rate of increase (when it has been determined that refueling has occurred).

The amount of fuel vapors generated in the fuel tank 31 is greatest during refueling. In particular, the amount of fuel vapors generated is considerable when the fuel tank 31 is refueled in an empty state. For this reason, the amount of fuel adsorbed in the canister 46 is greatest during refueling. In view of this situation, fuel vapors can be actively treated in the engine 13 by actuating the booster pump 47 during refueling when the amount of generated fuel vapors is considerable.

The above description is summarized below.

The controller 52 actuates the booster pump 47 when at least one of the following three conditions is met.

The first condition is when the adsorbed amount of fuel vapors detected by the adsorption amount detector 56 (canister temperature sensor 56) is greater than a prescribed reference adsorption amount.

The second condition is when a detection signal has been received from the lid open/close sensor 54 (refuel detector 54).

The third condition is when the rate of increase of the reservoir level detected by the fuel gauge 55 (refuel detector 55) is greater than a prescribed reference rate of increase.

Figure 5:
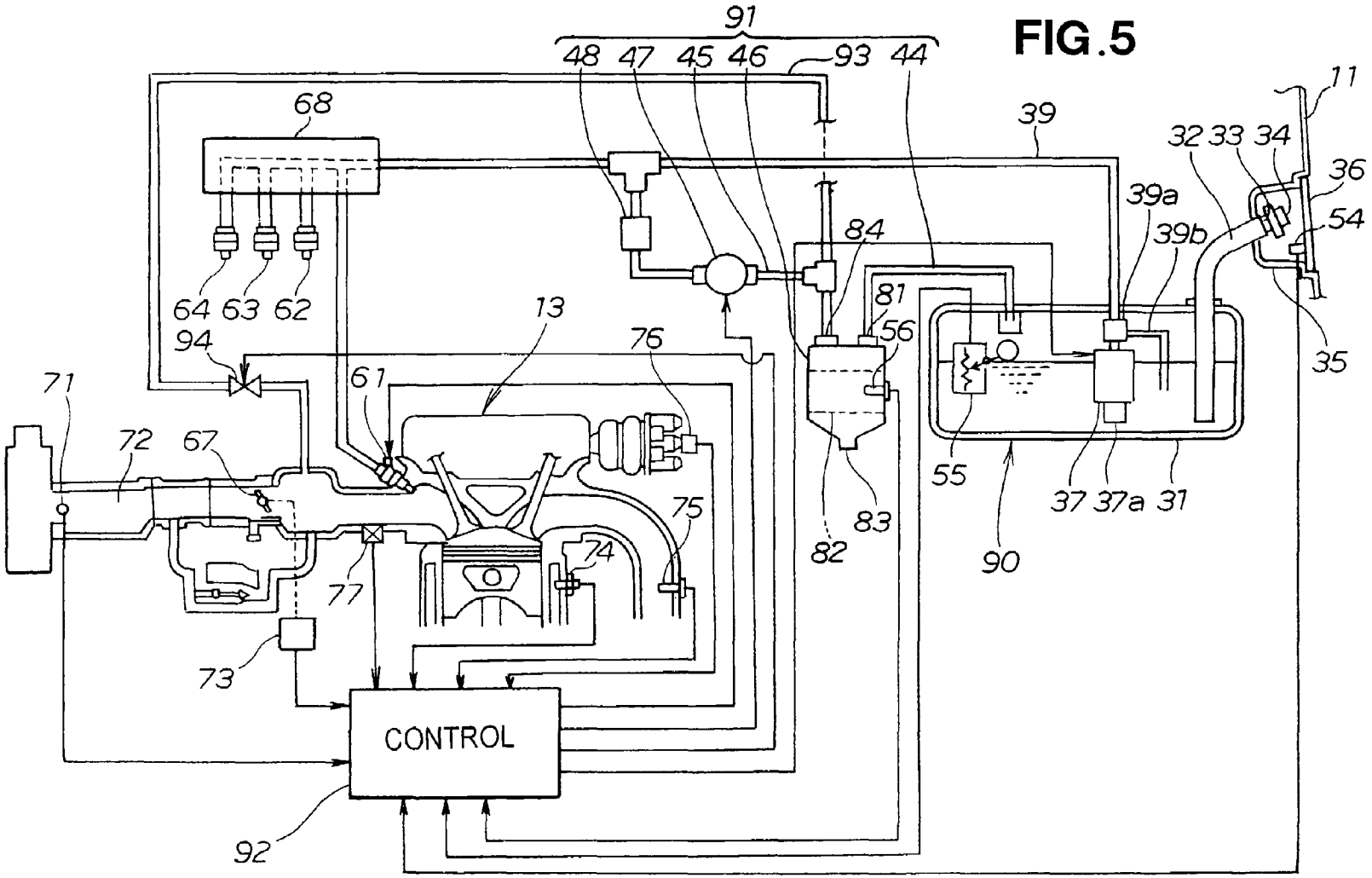
FIG. 5 is a diagrammatical view illustrating a modification of the fuel supply apparatus shown in FIG. 2.
Figure 6:
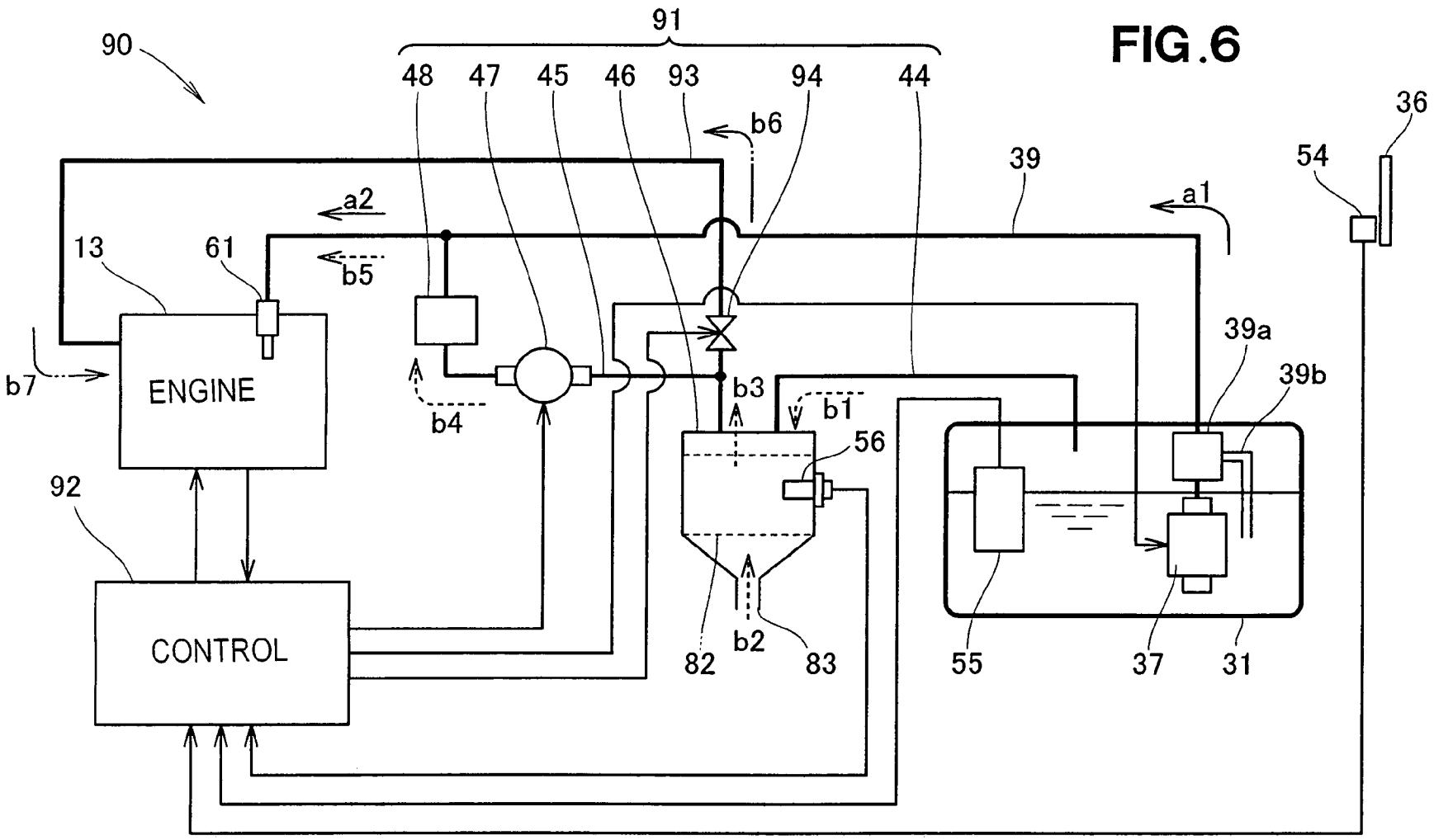
FIG. 6 is a diagrammatical view illustrating the modified fuel vapor treatment apparatus shown in FIG. 5.
Figure 7:
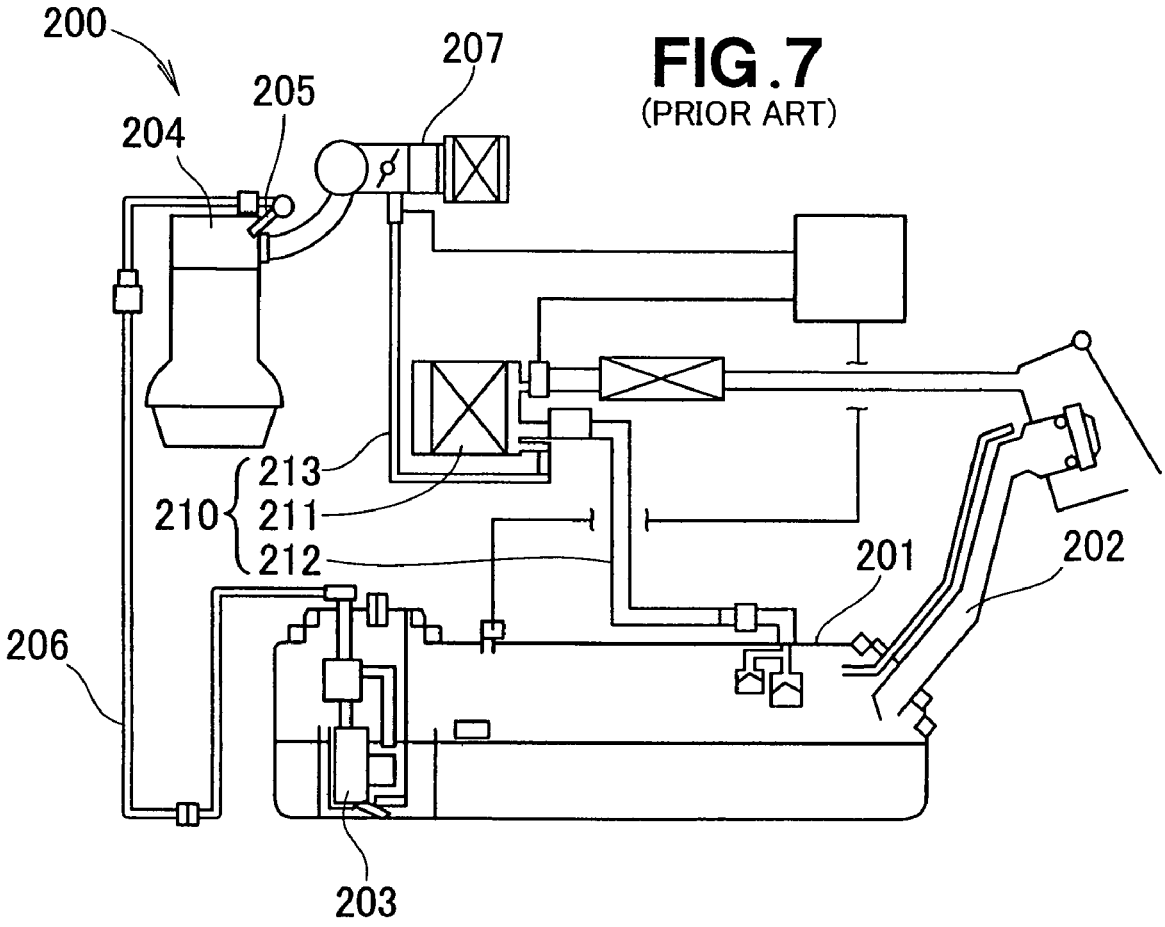
FIG.7 (PRIOR ART)
FIG. 7 is a schematic view illustrating a fuel supply apparatus equipped with a conventional fuel vapor treatment apparatus.

A modified example of the fuel supply apparatus 30 is described below with reference to FIGS. 5 and 6. The fuel supply apparatus 90 of the modified example features a configuration in which the fuel vapor treatment apparatus 40 shown in FIGS. 1 to 4 above is replaced with a fuel vapor treatment apparatus 91, as shown in FIGS. 5 and 6. Since the configuration is otherwise the same as that of the fuel supply apparatus 30 shown in FIGS. 1 to 4 above, the same reference numerals are used and a description is omitted.

In the fuel vapor treatment apparatus 91, the controller 52 of the fuel vapor treatment apparatus 40 shown in FIGS. 1 to 4 above is changed to a controller 92, and features the addition of an auxiliary fuel vapor supply tube 93 (intake system fuel vapor tube 93) and a purge valve 94.

The auxiliary fuel vapor supply tube 93 is an auxiliary component that branches from the second fuel vapor supply tube 45 and connects to the intake system 72 (see FIG. 5) of the engine 13.

The purge valve 94 is a normally-closed valve that opens only when a control signal has been received from the controller 92, and is composed of a solenoid, for example. Specifically, the purge valve 94 opens when the booster pump 47 is stopped. The purge valve 94 is disposed at a midway point in the auxiliary fuel vapor supply tube 93.

The controller 92 has the same function as the controller 52 shown in FIGS. 1 to 4 described above, and controls the purge valve 94.

More specifically, the controller 92 stops the booster pump 47 and opens the purge valve 94 in ordinary conditions. As a result, the fuel vapors inside the canister 46 pass through auxiliary fuel vapor supply tube 93, as indicated by the arrows b3, b6, and b7, and are fed to the intake system 72 (see FIG. 5) of the engine 13.

The controller 92 closes the purge valve 94 and operates the booster pump 47 when at least one of the following three conditions is met. The operating time is the same as the embodiment shown in FIGS. 1 to 4 above.

The first condition is when the adsorbed amount of fuel vapors detected by the adsorption amount detector 56 (canister temperature sensor 56) is greater than a prescribed reference adsorption amount.

The second condition is when a detection signal has been received from the lid open/close sensor 54 (refuel detector 54).

The third condition is when the rate of increase of the reservoir level detected by the fuel gauge 55 (refuel detector 55) is greater than a prescribed reference rate of increase.

Under any of the three conditions, the fuel vapors inside the canister 46 pass through the booster pump 47, second fuel vapor supply tube 45, and fuel supply tube 39 as indicated by the arrows b3, b4, and b5, and are fed to the fuel injectors 61, 62, 63, and 64 (see FIG. 5). Accordingly, the fuel vapors adsorbed in the canister 46 are rapidly combusted by the engine 13.

In the fuel vapor treatment apparatus 91 of the modified example, a switch can thus automatically be made between two pathways, i.e., a first pathway that feeds fuel vapors from the canister 46 to the fuel injectors 61, 62, 63, and 64 during normal operation, and a second pathway that feeds fuel vapors from the canister 46 to the intake system 72 under any of three conditions. In other words, the two pathways, i.e., the first and second pathways, can be switched in accordance with the condition. As a result, the exhaust gas of the engine 13 can be made cleaner, and greater latitude is achieved in the way fuel vapors are combusted by the engine 13.

In the present invention, the fuel vapor treatment apparatuses 40 and 91 are not limited to being provided to fuel supply apparatuses 30 and 90 mounted in a vehicle 10, and application can be made to equipment (e.g., small boats, work machines, and power generators) in which various engines are mounted.

The controllers 52 and 92 may be configured so that the amount of adsorbed fuel vapors is determined based on a value in which the temperature of the adsorbent 82 detected by the canister temperature sensor 56 is corrected by the outside temperature and the temperature inside the fuel tank 31.

The adsorption amount detector for detecting the amount of fuel vapors that have been adsorbed in the canister 46 is not limited to the canister temperature sensor 56. The adsorption amount detector may indirectly detect the adsorption amount by using a concentration detector for detecting the concentration of hydrocarbons (HC), or by using a weight detector for detecting the weight of the canister 46.

The fuel vapor treatment apparatus of the present invention can be used in passenger vehicles and other vehicles in which a gasoline engine is mounted.

Obviously, various minor changes and modifications of the present invention are possible in light of the above teaching. It is therefore to be understood that within the scope of the appended claims the invention may be practiced otherwise than as specifically described.

What is claimed is:

1. A fuel vapor treatment apparatus comprising:

a canister for temporarily retaining fuel vapors generated in a fuel tank; said fuel tank being fluidly connected with fuel injectors of an engine via a main fuel supply tube;

a first fuel vapor supply tube for allowing passage of the fuel vapors from the fuel tank to the canister;

a second fuel vapor supply tube for allowing passage of the fuel vapors from the canister to said fuel injectors of the engine; said second fuel vapor supply tube being connected to and in fluid communication with said main fuel supply tube; and a booster pump disposed on the second fuel vapor supply tube;

said booster pump being adapted:

to suction outside air via the canister to purge the fuel vapors from the retention by the canister, to compress the purged fuel vapors and the suctioned outside air, and to feed the purged fuel vapors and the suctioned outside air in the form of a compressed gas to the fuel injectors via the second fuel vapor supply tube and via said main fuel supply tube;

wherein during operation of the booster pump, said compressed gas is merged with liquid fuel flowing inside said main fuel supply tube.

2. The fuel vapor treatment apparatus of claim 1, wherein the second fuel vapor supply tube is connected to a midway point of the main fuel supply tube for supplying liquid fuel from the fuel tank to the fuel injectors, so that the purged fuel vapors are fed to the fuel injectors.

3. The fuel vapor treatment apparatus of claim 1, further comprising a controller for controlling a rate of discharge of the compressed gas from the booster pump in accordance with operating conditions when the engine is operating.

4. The fuel vapor treatment apparatus of claim 3, wherein the operating conditions include a level of opening of a throttle valve.

5. The fuel vapor treatment apparatus of claim 3, wherein the operating conditions include an engine speed.

6. The fuel vapor treatment apparatus of claim 1, further comprising: an amount detector for detecting an amount of the fuel vapors retained by the canister; and a controller for actuating the booster pump only when the amount of retention is greater than a predetermined reference retention amount.

7. The fuel vapor treatment apparatus of claim 1, further comprising: a refuel detector for detecting that the fuel tank is being refueled; and a controller for actuating the booster pump in accordance with a detection signal from the refuel detector.

8. The fuel vapor treatment apparatus of claim 7, wherein the refuel detector comprises a lid open/close sensor for detecting that the refueling lid, which is opened when fuel is to be fed from the exterior to the fuel tank, has been opened.

9. The fuel vapor treatment apparatus of claim 7, wherein the refuel detector comprises a fuel gauge for detecting a reservoir level of the fuel held in the fuel tank.

10. The fuel vapor treatment apparatus of claim 1, further comprising: an auxiliary fuel vapor supply tube branched from the second fuel vapor supply tube and connected to an intake system of the engine; and a purge valve disposed on the auxiliary fuel vapor supply tube and adapted to open when the booster pump is stopped.

11. The fuel vapor treatment apparatus of claim 1, wherein said booster pump increases pressure of said compressed gas that flows though said second fuel vapor supply tube to a substantially same pressure as a pressure of liquid fuel flowing inside the main supply tube.

12. The fuel vapor treatment apparatus of claim 1, further comprising a temperature sensor disposed in the canister for detecting temperature of an adsorbent disposed in the canister.

13. A fuel vapor treatment apparatus comprising:

a canister for temporarily retaining fuel vapors generated in a fuel tank fluidly connected with fuel injectors of an engine via a main fuel supply tube, said canister having an adsorbent dispoed therein, and said canister having an air hole formed therein;

a first fuel vapor supply tube for allowing passage of the fuel vapors from the fuel tank to the canister;

a second fuel vapor supply tube for allowing passage of the fuel vapors from the canister to the fuel injectors of the engine;

a booster pump disposed on the second fuel vapor supply tube; said booster pump operable to suction outside air via the air hole of the canister to purge the fuel vapors from the canister, to compress the purged fuel vapors and the suctioned outside air, and to feed the purged fuel vapors and the suctioned outside air in the form of a compressed gas to the fuel injectors via the second fuel vapor supply tube, wherein during operation of the booster pump, said compressed gas is merged with liquid fuel flowing inside the main fuel supply tube;

a controller for controlling operation of said booster pump;

a temperature sensor disposed in the canister for detecting temperature of the adsorbent, and being operatively connected with said controller;

wherein said controller determines an adsorption amount of fuel vapor in said canister based on a sensed temperature of said adsorbent; and wherein said controller operates said booster pump when said controller determines that an adsorption amount of fuel vapor in said canister is greater than a predetermined adsorption amount.

14. The treatment apparatus of claim 13, wherein the second fuel vapor supply tube is connected to a substantially midway point of said main fuel supply tube for supplying liquid fuel from the fuel tank to the fuel injectors such that the purged fuel vapors are fed to the fuel injectors via said main fuel supply tube.

15. The treatment apparatus of claim 13, wherein said controller controls a rate of discharge of the compressed gas from the booster pump in accordance with operating conditions of the engine; wherein said operating conditions include a level of opening of a throttle valve and an engine speed.

16. The treatment apparatus of claim 13, further comprising an auxiliary fuel vapor supply tube branched from the second fuel vapor supply tube and connected to an intake system of the engine; and a purge valve disposed on the auxiliary fuel vapor supply tube and adapted to open when the booster pump is stopped.

17. A fuel vapor treatment apparatus comprising:

a canister for temporarily retaining fuel vapors generated in a fuel tank fluidly connected with fuel injectors of an engine via a main fuel supply tube, said canister having an air hole formed therein;

a first fuel vapor supply tube for allowing passage of the fuel vapors from the fuel tank to the canister;

a second fuel vapor supply tube for allowing passage of the fuel vapors from the canister to the fuel injectors of the engine;

a booster pump in fluid communication with the second fuel vapor supply tube; said booster pump operable to suction outside air via the air hole of the canister to purge the fuel vapors from the canister, to compress the purged fuel vapors and the suctioned outside air, and to feed the purged fuel vapors and the suctioned outside air in the form of a compressed gas to the fuel injectors via the second fuel vapor supply tube, wherein during operation of the booster pump, said compressed gas is merged with liquid fuel flowing inside the main fuel supply tube;

a controller for controlling operation of said booster pump; and a refuel detector dispsoed in said fuel tank, and operatively connected with said controller;

wherein said controller operates said booster pump based on a detection signal received from said refuel detector.

18. The treatment apparatus of claim 17, wherein said refuel detector is a lid open/close sensor.

19. The treatment apparatus of claim 17, wherein said refuel detector is a fuel gauge which detects rate of increase of reservoir level of the fuel held in the fuel tank; and wherein said controller operates said booster pump when the rate of increase of the reservoir level detected by the fuel gauge is greater than a predetermined reference rate of increase.

* * * * *